US006505363B2

(12) United States Patent
Davis

(10) Patent No.: US 6,505,363 B2
(45) Date of Patent: Jan. 14, 2003

(54) DEVICE FOR ADJUSTING THE PLANE OF A MATTRESS

(76) Inventor: Rocky E. Davis, 4310 Greenwood, Joplin, MO (US) 64804

( * ) Notice: Subject to any disclaimer, the term of this patent is extended or adjusted under 35 U.S.C. 154(b) by 0 days.

(21) Appl. No.: 09/747,876

(22) Filed: Dec. 26, 2000

(65) Prior Publication Data

US 2002/0078500 A1 Jun. 27, 2002

(51) Int. Cl.[7] ..... A47C 17/80
(52) U.S. Cl. ..... 5/118; 5/608; 296/190.02
(58) Field of Search ..... 5/118, 608, 11, 5/611, 612; 296/190.02

(56) References Cited

U.S. PATENT DOCUMENTS

| | | | | | |
|---|---|---|---|---|---|
| 3,299,447 | A | * | 1/1967 | Dome | 5/118 |
| 3,371,359 | A | * | 3/1968 | Dome | 5/118 |
| 3,760,436 | A | | 9/1973 | Zach et al. | |
| 3,900,906 | A | * | 8/1975 | Berthelsen | 5/608 |
| 3,902,205 | A | * | 9/1975 | Bell | 5/118 |
| 4,144,601 | A | | 3/1979 | Anderson et al. | |
| 4,196,483 | A | * | 4/1980 | Lefler et al. | 5/118 |
| 4,497,078 | A | * | 2/1985 | Vogel et al. | 5/118 |
| 4,541,134 | A | * | 9/1985 | Black et al. | 5/118 |
| 4,669,139 | A | | 6/1987 | Richter, Jr. | |
| 4,839,932 | A | | 6/1989 | Williamson | |
| 4,979,248 | A | * | 12/1990 | Kelley | 5/118 |
| 4,989,281 | A | * | 2/1991 | Christensen | 5/118 |
| 5,095,560 | A | * | 3/1992 | Volker | 5/11 |
| 5,218,728 | A | | 6/1993 | Lloyd et al. | |
| 5,285,995 | A | * | 2/1994 | Gonzalez et al. | 248/550 |
| 5,294,085 | A | * | 3/1994 | Lloyd et al. | 248/562 |
| 5,341,820 | A | * | 8/1994 | Hammett | 5/611 |
| D355,311 | S | | 2/1995 | Bergerson | |
| 5,398,356 | A | * | 3/1995 | Pfleger | 5/608 |
| 5,621,933 | A | * | 4/1997 | Knapp et al. | 5/608 |
| RE35,572 | E | * | 7/1997 | Lloyd et al. | 248/562 |
| 5,822,813 | A | * | 10/1998 | Powell | 5/118 |
| 2002/0078500 | A1 | * | 6/2002 | Davis | 5/118 |

* cited by examiner

*Primary Examiner*—Robert G. Santos

(57) ABSTRACT

A device for adjusting the plane of a mattress for changing the orientation of a plane of a mattress in a semi-truck. The device for adjusting the plane of a mattress includes a housing. The housing has a top wall, a bottom wall, a front wall, a back wall, a first side wall and a second side wall. The first side wall has a hole extending therethrough. The front wall has an opening extending therethrough. Each of a plurality of pistons is securely mounted in the housing. Each of the pistons is positioned in a different corner of the housing such that each of the corners of the housing has a piston located generally adjacent thereto. Each of a plurality of shafts is extendably positioned in one of the pistons. Each of the pistons is adapted to selectively extend the shafts upwardly through the top wall. Each of a plurality of air pumps is operationally coupled to a pair of the pistons respectively positioned adjacent to one of the side walls. An air intake hose extends through the opening in the front wall and is fluidly coupled to each of the pumps. A power supply comprises a cord operationally coupled to each of the air pumps. Each of the shafts has a free end pivotally coupled to a bottom side of a panel. An actuator actuates each of the pump's to change the orientation of the plane of the panel.

5 Claims, 3 Drawing Sheets

DEVICE FOR ADJUSTING THE PLANE OF A MATTRESS

BACKGROUND OF THE INVENTION

1. Field of the Invention

The present invention relates to reclining bed devices and more particularly pertains to a new device for adjusting the plane of a mattress for changing the orientation of a plane of a mattress in a semi-truck.

2. Description of the Prior Art

The use of reclining bed devices is known in the prior art. More specifically, reclining bed devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,669,139; 5,218,728; 3,760,436; 4,144,601; 4,839,932; and U.S. Des. Pat. No. 355,311.

While these devices fulfill their respective, particular objectives and requirements, the aforementioned patents do not disclose a new device for adjusting the plane of a mattress. The inventive device includes a housing. The housing has a top wall, a bottom wall, a front wall, a back wall, a first side wall and a second side wall. The first side wall has a hole extending therethrough. The front wall has an opening extending therethrough. Each of a plurality of pistons is securely mounted in the housing. Each of the pistons is positioned in a different corner of the housing such that each of the corners of the housing has a piston located generally adjacent thereto. Each of a plurality of shafts is extendably positioned in one of the pistons. Each of the pistons is adapted to selectively extend the shafts upwardly through the top wall. Each of a plurality of air pumps is operationally coupled to a pair of the pistons respectively positioned adjacent to one of the side walls. An air intake hose extends through the opening in the front wall and is fluidly coupled to each of the pumps. A power supply comprises a cord operationally coupled to each of the air pumps. Each of the shafts has a free end pivotally coupled to a bottom side of a panel. An actuator actuates each of the pumps to change the orientation of the plane of the panel.

In these respects, the device for adjusting the plane of a mattress according to the present invention substantially departs from the conventional concepts and designs of the prior art, and in so doing provides an apparatus primarily developed for the purpose of changing the orientation of a plane of a mattress in a semi-truck.

SUMMARY OF THE INVENTION

In view of the foregoing disadvantages inherent in the known types of reclining bed devices now present in the prior art, the present invention provides a new device for adjusting the plane of a mattress construction wherein the same can be utilized for changing the orientation of a plane of a mattress in a semi-truck.

The general purpose of the present invention, which will be described subsequently in greater detail, is to provide a new device for adjusting the plane of a mattress apparatus and method which has many of the advantages of the reclining bed devices mentioned heretofore and many novel features that result in a new device for adjusting the plane of a mattress which is not anticipated, rendered obvious, suggested, or even implied by any of the prior art reclining bed devices, either alone or in any combination thereof.

To attain this, the present invention generally comprises a housing. The housing has a top wall, a bottom wall, a front wall, a back wall, a first side wall and a second side wall. The first side wall has a hole extending therethrough. The front wall has an opening extending therethrough. Each of a plurality of pistons is securely mounted in the housing. Each of the pistons is positioned in a different corner of the housing such that each of the corners of the housing has a piston located generally adjacent thereto. Each of a plurality of shafts is extendably positioned in one of the pistons. Each of the pistons is adapted to selectively extend the shafts upwardly through the top wall. Each of a plurality of air pumps is operationally coupled to a pair of the pistons respectively positioned adjacent to one of the side walls. An air intake hose extends through the opening in the front wall and is fluidly coupled to each of the pumps. A power supply comprises a cord operationally coupled to each of the air pumps. Each of the shafts has a free end pivotally coupled to a bottom side of a panel. An actuator actuates each of the pumps to change the orientation of the plane of the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new device for adjusting the plane of a mattress apparatus and method which has many of the advantages of the reclining bed devices mentioned heretofore and many novel features that result in a new device for adjusting the plane of a mattress which is not anticipated, rendered obvious, suggested, or even implied by any of the prior art reclining bed devices, either alone or in any combination thereof.

It is another object of the present invention to provide a new device for adjusting the plane of a mattress which may be easily and efficiently manufactured and marketed.

It is a further object of the present invention to provide a new device for adjusting the plane of a mattress which is of a durable and reliable construction.

An even further object of the present invention is to provide a new device for adjusting the plane of a mattress which is susceptible of a low cost of manufacture with regard to both materials and labor, and which accordingly is then susceptible of low prices of sale to the consuming public, thereby making such device for adjusting the plane of a mattress economically available to the buying public.

Still yet another object of the present invention is to provide a new device for adjusting the plane of a mattress which provides in the apparatuses and methods of the prior art some of the advantages thereof, while simultaneously overcoming some of the disadvantages normally associated therewith.

Still another object of the present invention is to provide a new device for adjusting the plane of a mattress for changing the orientation of a plane of a mattress in a semi-truck.

Yet another object of the present invention is to provide a new device for adjusting the plane of a mattress which includes a housing. The housing has a top wall, a bottom wall, a front wall, a back wall, a first side wall and a second side wall. The first side wall has a hole extending therethrough. The front wall has an opening extending therethrough. Each of a plurality of pistons is securely mounted in the housing. Each of the pistons is positioned in a different corner of the housing such that each of the corners of the housing has a piston located generally adjacent thereto. Each of a plurality of shafts is extendably positioned in one of the pistons. Each of the pistons is adapted to selectively extend the shafts upwardly through the top wall Each of a plurality of air pumps is operationally coupled to a pair of the pistons respectively positioned adjacent to one of the side walls. An air intake hose extends through the opening in the front wall and is fluidly coupled to each of the pumps. A power supply comprises a cord operationally coupled to each of the air pumps. Each of the shafts has a free end pivotally coupled to a bottom side of a panel. An actuator actuates each of the pumps to change the orientation of the plane of the panel.

Still yet another object of the present invention is to provide a new device for adjusting the plane of a mattress that is positionable in a semi-truck for altering the plane of a mattress so that it is level when the truck is parked in an uneven area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
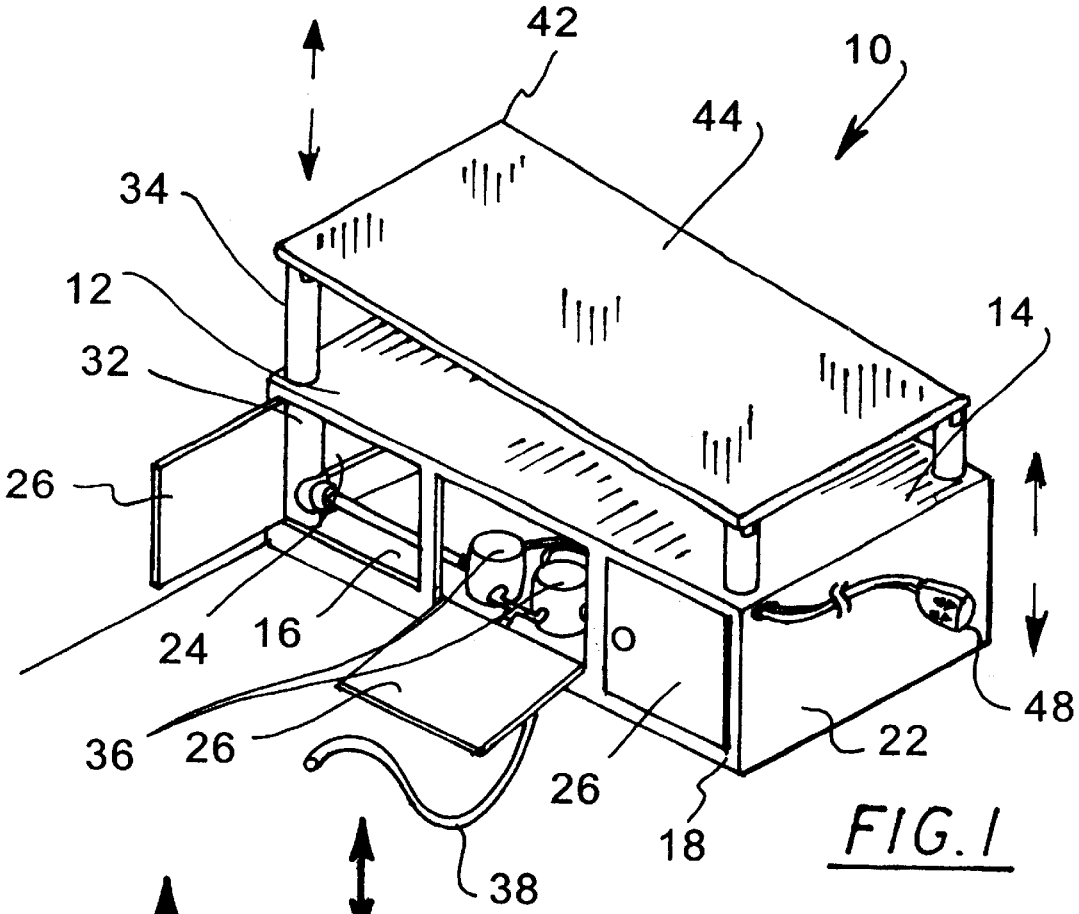
FIG. 1 is a schematic perspective view of a new device for adjusting the plane of a mattress according to the present invention.
Figure 2:
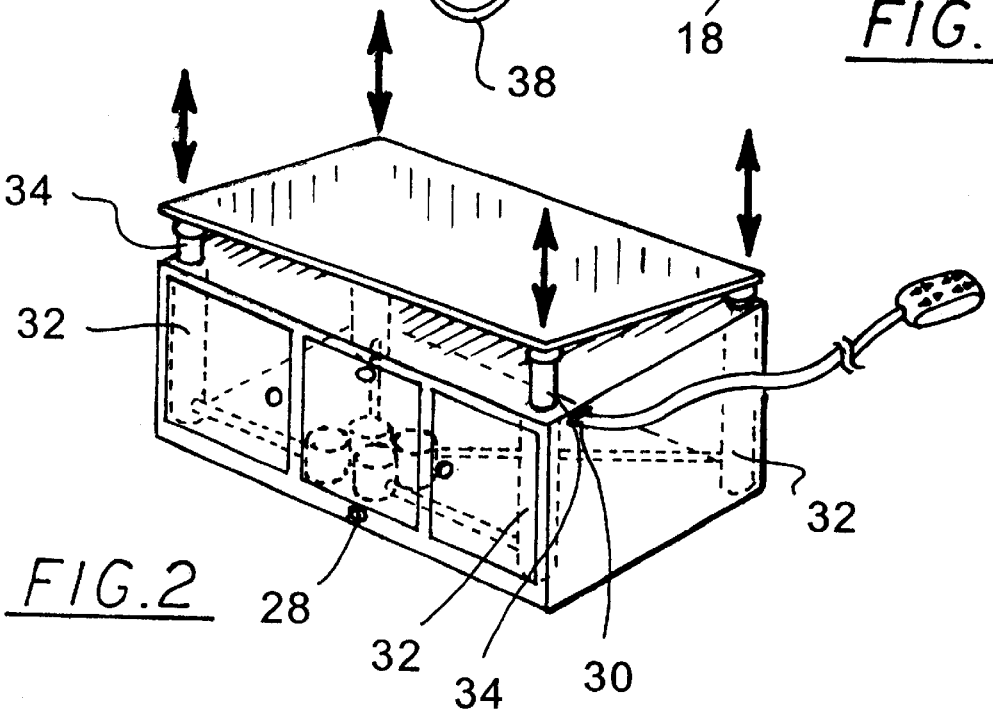
FIG. 2 is a schematic perspective view of the present invention.
Figure 4:
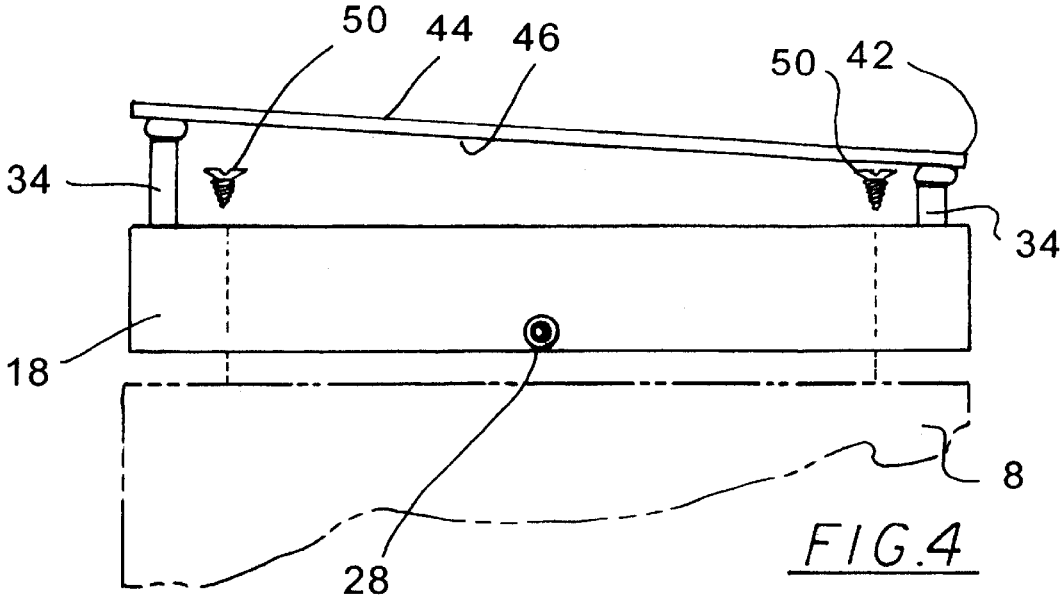
FIG. 4 is a schematic side view of the present invention.
Figure 3:
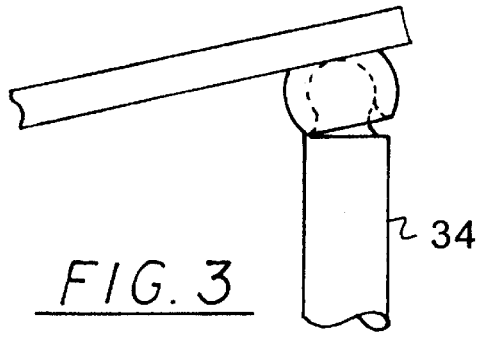
FIG. 3 is a schematic side view of a shaft of the present invention.
Figure 5:
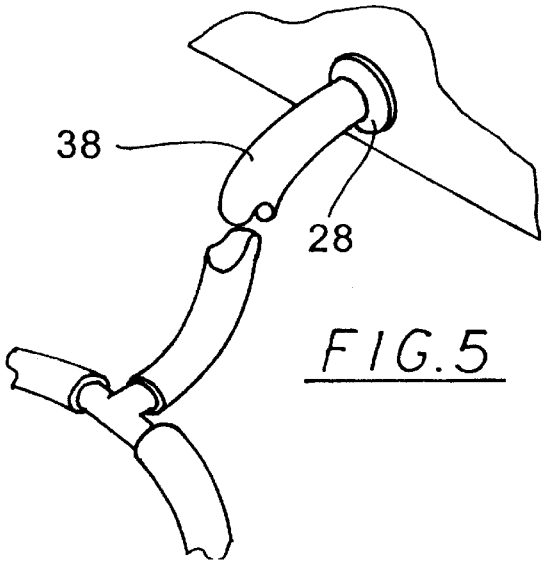
FIG. 5 is a schematic perspective view of the air intake hose of the present invention.
Figure 6:
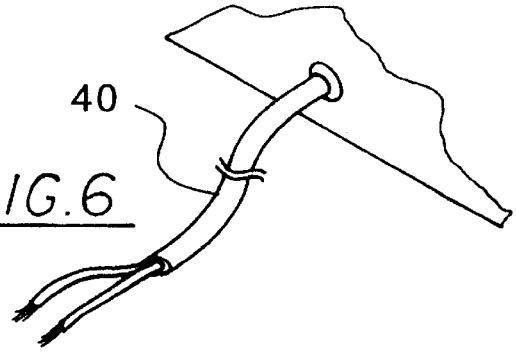
FIG. 6 is a schematic perspective view of a cord of the present invention.

With reference now to the drawings, and in particular to FIGS. 1 through 8 thereof, a new device for adjusting the plane of a mattress embodying the principles and concepts of the present invention and generally designated by the reference numeral 10 will be described.

As best illustrated in FIGS. 1 through 8, the device for adjusting the plane of a mattress 10 generally comprises a housing 12. The housing 12 has a top wall 14, a bottom wall 16, a front wall 18, a back wall, a first side wall 22 and a second side wall 24. The front wall 18 has a plurality of doors 26 therein. Each of the doors 26 is selectively positioned between an open position and a closed position. The first side wall 22 has a hole 30 extending therethrough, and the front wall 18 has an opening 28 extending therethrough.

Each of a plurality of pistons 32 is securely mounted in the housing 12. Each of the pistons 32 is positioned in a different corner of the housing 12 such that each of the corners of the housing has a piston 32 located generally adjacent thereto. Each of a plurality of shafts 34 is extendably positioned in one of the pistons. Each of the pistons 32 is adapted to selectively extend the shafts 34 upwardly through the top wall 14. Each of the shafts 34 may preferably extend one foot above the top wall 14.

Each of a plurality of air pumps 36 is operationally coupled to one of the pistons 32 such that there are 4 air pumps. Each of the air pumps 34 is securely mounted in the housing 12. Another version uses only 2 pumps 36, each of the pumps 36 being coupled to a pair of pistons 32. Each of the pair being adjacent to the same side wall 22, 24.

An air intake hose 38 extends through the opening 28 in the front wall and is fluidly coupled to the pumps 36. The air intake hose 38 may be coupled to the compressed air supply from a semi-truck.

A power supply 40 comprises a cord and is operationally coupled to each of the air pumps 36. The power supply 40 may be hard wired into the electrical system of the semi-truck, or it may be a plug for operationally coupling to a conventional cigarette lighter port.

A panel 42 is substantially rigid and has a top side 44 and a bottom side 46. Each of the shafts 34 has a free end pivotally coupled to the bottom side 46 of the panel 42. The panel 42 is preferably rectangular and has four corners. Each of the shafts 34 is positioned generally adjacent to one of the corners of the panel 42.

Figure 7:
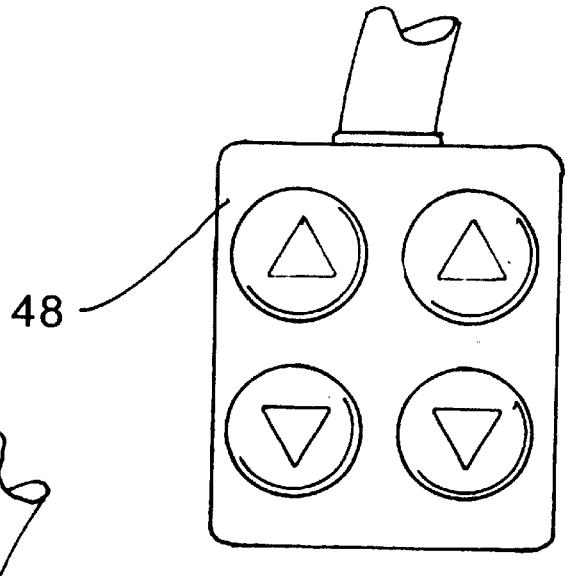
FIG. 7 is a schematic top view of an actuator of the present invention.
Figure 8:
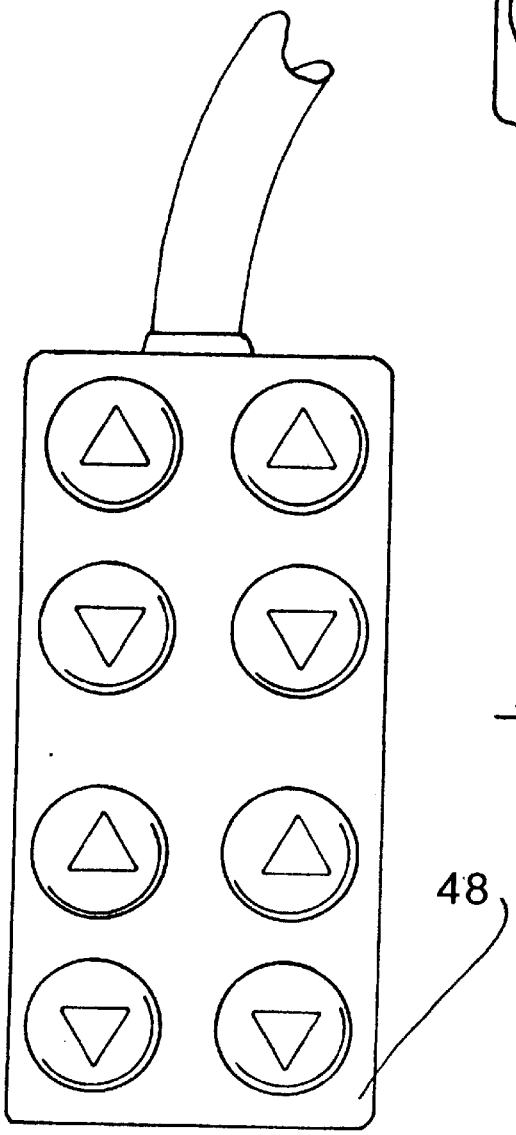
FIG. 8 is a schematic top view of an actuator of the present invention.

An actuator 48 actuates each of the pumps 36 such that the shafts 34 may each individually be selectively raised and lowered. The actuator 48 is electrically coupled to each of the pumps 36. The actuator 48 extends through the hole 30 in the first side wall 22. The actuator 48 is a conventional controller having a keypad thereon with up and down buttons for each of the pumps. FIG. 7 shows the actuator used with two pumps and FIG. 8 shows the actuator used with four pumps.

A plurality of fastening means 50 removably fastens the bottom wall 16 to the cab 8. Each of the fastening means 50 preferably comprises a screw.

In use, the device 10 is placed in the cab and fastened down so that it does not shift during movement. A mattress, not shown, is positioned on top of the panel 42, and the pistons 32 are used to level the panel 42 when the semi-truck is not on a flat surface. This allows a driver, trying to sleep, to sleep on a horizontal surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mattress leveling device, said device being positionable in a cab of a semi-truck, said device comprising:

a housing, said housing having a top wall, a bottom wall, a front wall, a back wall, a first side wall and a second side wall, said first side wall having a hole extending therethrough, said front wall having an opening extending therethrough;

a plurality of pistons, each of said pistons being securely mounted in said housing, each of said pistons being positioned in a different corner of said housing such that each of said corners of said housing has a piston located generally adjacent thereto, each of said pistons extending substantially perpendicular to the top wall of said housing and extending substantially parallel to each of the other said pistons, each of a plurality of shafts being extendably positioned in one of said pistons, each of said pistons being adapted to selectively extend said shafts upwardly through said top wall such that each of said shafts extends substantially perpendicular to the top wall and extends substantially parallel to each of the other said shafts as said shafts are selectively raised and lowered;

a plurality of air pumps, each of said air pumps being operationally coupled to a pair of said pistons respectively positioned adjacent to one of said side walls;

an air it take hose, said air intake hose extending through said opening in said front wall and being fluidly coupled to said pumps;

a power supply comprising a cord being operationally coupled to each of said air pumps;

a substantially rectangular panel with four corners, said panel being substantially rigid and having a top side and a bottom side, each of said shafts having a free end pivotally coupled to said bottom side of said panel at one of said corners such that each of said pistons and said shafts are substantially vertically oriented;

an actuator for actuating each of said pumps.

2. The mattress leveling device as in claim 1, wherein each of said air pumps is operationally coupled to one of said pistons such that there are four air pumps, each of said air pumps being securely mounted in said housing.

3. The mattress leveling device as in claim 2, wherein said actuator is electrically coupled to each of said pumps, said actuator extending through said hole in said first side wall, said actuator having a keypad thereon.

4. The mattress leveling device as in claim 1, further comprising:

a plurality of fastening means for removably fastening said bottom wall to said cab, each of said fastening means comprising a screw.

5. A mattress leveling device, said device being positionable in a cab of a semi-truck, said device comprising:

a housing, said housing having a top wall, a bottom wall, a front wall, a back wall, a first side wall and a second side wall, said front wall having a plurality of doors therein, each of said doors being selectively positioned between an open position and a closed position, said first side wall having a hole extending therethrough, said front wall having an opening extending therethrough;

a plurality of pistons, each of said pistons being securely mounted in said housing, each of said pistons being positioned in a different corner of said housing such that each of said corners of said housing has a piston located generally adjacent thereto, each of a plurality of shafts being extendably positioned in one of said pistons, each of said pistons being adapted to selectively extend said shafts upwardly through said top wall;

a plurality of air pumps, each of said air pumps being operationally coupled to one of said pistons such that there are 4 air pumps, each of said air pumps being securely mounted in said housing;

an air intake hose, said air intake hose extending through said opening in said front wall and being fluidly coupled to said pumps;

a power supply comprising a cord being operationally coupled to each of said air pumps;

a panel, said panel being substantially rigid and having a top side and a bottom side, each of said shafts having a free end pivotally coupled to said bottom side of said panel;

an actuator for actuating each of said pump such that said shafts may each individually be selectively raised and lowered, said actuator being electrically coupled to each of said pumps, said actuator extending through said hole in said first side wall, said actuator having a keypad thereon; and a plurality of fastening means for removably fastening said bottom wall to said cab, each of said fastening means comprising a screw.

* * * * *